US006050733A

United States Patent [19]

Yamamoto

[11] Patent Number: 6,050,733

[45] **Date of Patent: *Apr. 18, 2000**

[54] TYPING METHOD FOR A PHOTOGRAPHIC PRINTER AND TYPING DEVICE FOR THE SAME

[75] Inventor: Takashi Yamamoto, Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/931,494

[22] Filed: Sep. 16, 1997

[30] Foreign Application Priority Data

Sep. 17, 1996 [JP] Japan ..... 8-244818

[51] Int. Cl.[7] ..... B41J 3/54

[52] U.S. Cl. ..... 400/82; 355/40; 400/149

[58] Field of Search ..... 400/149, 82, 17, 400/18, 150, 151; 355/40, 70

[56] References Cited

U.S. PATENT DOCUMENTS 4,481,880 11/1984 Kurosawa et al. ..... 400/323
4,576,490 3/1986 Isobe ..... 400/149
4,684,269 8/1987 Miki ..... 400/149
5,330,274 7/1994 Schimmelpfennig et al. ..... 400/149
5,336,873 8/1994 Imamura ..... 235/462

*Primary Examiner*—Christopher A. Bennett
*Attorney, Agent, or Firm*—Sughrue, Mion, Zinn, Macpeak & Seas, PLLC

[57] ABSTRACT

Two typing units are disposed in a photographic printer, facing a back face of an exposed color paper. The typing unit comprises a typing head and an ink ribbon cassette which is endless type and is removable. As for 135-type photographic film, one-line typing mode is selected. In this case, one of the typing units is actuated to type information concerning a frame number of the photographic film, an exposure correction value and so forth for the back face of the color paper in one line. In this one-line typing mode, the typing unit being used is changed whenever the typing relative to one photographic film is over so that ink ribbons of the typing units are prevented from being unequally consumed. As for IX240-type photographic film, two-line typing mode is selected. In this mode, both of the typing units are actuated to type various information in two lines.

12 Claims, 5 Drawing Sheets

TYPING METHOD FOR A PHOTOGRAPHIC PRINTER AND TYPING DEVICE FOR THE SAME

BACKGROUND OF THE INVENTION

1. Field of the Invention

The present invention relates to a typing method and a typing device used in a photographic printer and for typing information of characters, numerals and the like for each photo print.

2. Description of the Related Art

In printing of 135-type photographic film and IX240-type photographic film, back printing is carried out. The back printing is to type characters, numerals and the like on a back face of a photo print. In order to carry out the back printing, a photographic printer in which a back printing device is disposed in front of or behind an exposure station is used.

The 135-type photographic film has a width of 35 mm and is provided with perforations formed in both sides thereof at constant pitch. This photographic film is on sale in a state that a film leader is drawn out from a cartridge. With respect to printing of the 135-type photographic film, an order number of the photographic film, a frame number, an exposure correction value and so forth are printed on the back face of the photo print in one line.

The IX240-type photographic film is called new photographic film or advanced photo system film and provided with two perforations formed in one side thereof at constant pitch. This photographic film is on sale in a state that the whole of the photographic film is wound up in the cartridge which is made of plastic. A leader of the photographic film is sent out from the cartridge by rotating a spool. With respect to printing of the IX240-type photographic film, a message, a photographic date, a photographic condition, an order number of the photographic film, a frame number, an exposure correction value, ID-number of photofinishing laboratory, and so forth are printed on the back face of the photo print in two lines.

In the photographic printer which is capable of printing for both of the 135-type and the IX240-type photographic film, two typing units of ink ribbon type are juxtaposed in front of or behind the exposure station. The typing unit is constituted of an ink ribbon cassette and a typing head. The ink ribbon cassette is an endless type and is exchangeable. The typing head is disposed behind the ink ribbon and is wire dot type. For the 135-type photographic film, one-line typing mode is selected so that one line is typed by driving one of the typing units. For the IX240-type photographic film, two-line typing mode is selected so that two lines are typed by driving both of printing units.

Although a percentage of use of the IX240-type photographic film increases, however, a total amount thereof is still small because it is not long since the commencement of sale. Accordingly, the photographic films for which printing is ordered are almost all 135-type. For the 135-type photographic film, the one-line typing mode is selected. In this mode, only one typing unit of the two typing units, which is predetermined, is used. Therefore, with respect to the typing unit used in the one-line typing mode, ink of the ink ribbon thereof is reduced much faster than the other.

In the case of one-line typing, although the typing density becomes low, it is not noticeable. However, in the case of two-line typing, the typing density of the one line becomes light, however, the typing density of the other line is dark so that the difference in the typing density is rather noticeable.

Accordingly, there arises a problem in that the quality of typing is lowered.

SUMMARY OF THE INVENTION

In view of the foregoing, it is a primary object of the present invention to provide a typing method and a typing device for a photographic printer in which a difference in typing density of each line does not occur in case of the plural-line typing mode.

It is a second object of the present invention to provide a typing method and a typing device for a photographic printer in which a waste of an ink ribbon cassette is avoided when the ink ribbon cassette is exchanged.

It is a third object of the present invention to provide a typing method and a typing device for a photographic printer in which a typing position is always the same in case of an one-line typing mode.

In order to achieve the above and other objects, as to the typing method and the typing device for the photographic printer according to the present invention, a plurality of typing units provided in a photographic printer are alternately driven one by one at prescribed intervals when a first typing mode is selected. The typing unit types various information concerning photographic information, user information and so forth on a photo print, preferably, on a back face of the photo print.

In a preferred embodiment, two typing units are provided in the photographic printer. When the first typing mode is selected, one of the typing units is driven to type the information for the photo print in one line. On the other hand, when a second typing mode is selected, both of the typing units are driven to type the information for the photo print in two lines.

While the first typing mode is selected, if one of the typing units continues to be used, typing densities of the two typing units become different from each other. This is not preferable because a difference between the typing densities is noticeable when the two lines are typed in the second typing mode.

In order to prevent the difference between the typing densities from occurring, the typing unit driven for typing the information is changed to the other one at prescribed intervals. In other words, the typing unit is alternately driven in the first typing mode. Accordingly, the typing densities of both typing units are decreased in a similar way so that the difference between the typing densities does not occur when the two lines are typed due to selecting the second typing mode.

In another embodiment, the typing unit is adapted to be moved. The driven typing unit is moved to a predetermined position and types the information. Accordingly, the typing is always carried out at a prescribed position relative to each photo print in the case of the first typing mode.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
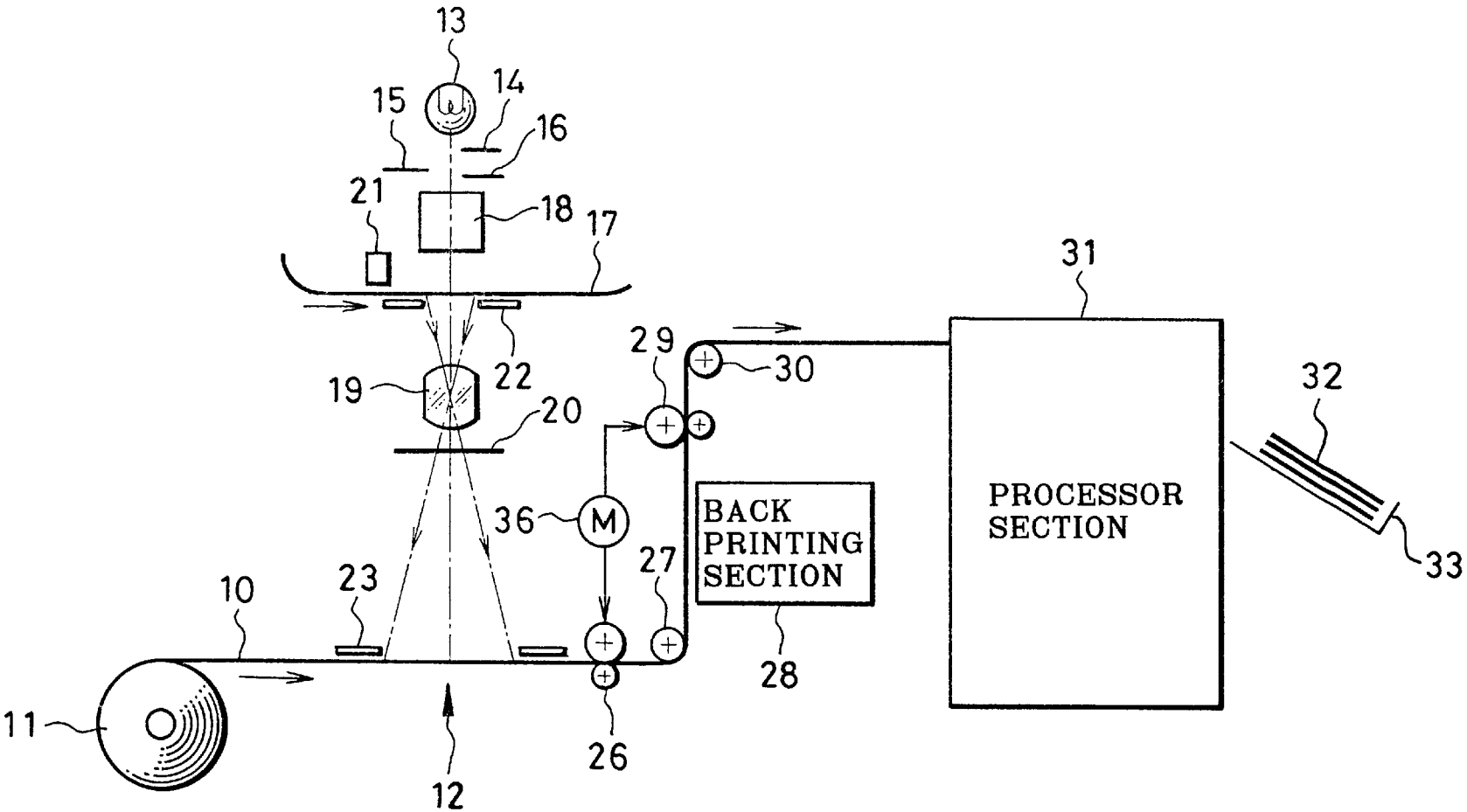
FIG. 1 is a schematic illustration showing a photographic printer provided with a back printing section.

In FIG. 1, a color paper 10 is drawn out from the paper roll 11 and transported toward an exposure station 12. The color paper 10 is a continuous photographic paper. Above the exposure station 12, there are disposed a white light source 13, a yellow filter 14, a magenta filter 15, and a cyan filter 16. As to these three-color filters 14, 15 and 16, an amount inserted into an optical path is adjusted in accordance with three-color densities of a frame formed on a photographic film 17.

Printing light regulated by passing through a part of the three-color filters 14, 15 and 16 is diffused by a diffusion box 18. The frame of the photographic film 17 is set under the diffusion box 18. The printing light passing through the frame is projected to the color paper 10 via a print lens 19 while a shutter 20 is opened.

When the photographic film 17 is IX240-type, a transparent magnetic recording layer is formed on a whole rear face of the photographic film 17. Both sides of the magnetic recording layer excepting a picture portion are used as two tracks. One of the tracks is for a user and the other of the tracks is for a photofinishing laboratory. In a side portion (a frame exclusive portion) of each frame relative to each track, various information regarding the frame is magnetically recorded. In a leader portion (a common portion), common information regarding each frame is recorded.

In the frame exclusive portion of the track for the user, user information of a photographic date, photographic condition, a print number, a print size, a message and so forth are recorded by a magnetic head installed in the camera every each frame. In the frame exclusive portion of the track for the photofinishing laboratory, laboratory information of an exposure correction value and so forth are recorded by a magnetic head installed in the camera.

In the common portion of the track for the user, a film manufacturer, a kind of a film, film sensitivity, a photographable number of the film and so forth are recorded when the film is manufactured. On the other hand, in the common portion of the track for the photofinishing laboratory, ID number of the laboratory, ID number of the photographic printer, a film order number and so forth are recorded at the laboratory.

While the frame of the photographic film is advanced, a magnetic head 21 reads out the user information of the frame for printing. Incidentally, the magnetic head for recording the laboratory information is omitted. Reference numerals 22 and 23 denote a mask plate.

The color paper 10 passing through the exposure station 12 is sent to a back printing section 28 via a transporting roller pair 26 and a guide roller 27. In the back printing section 28, one-line typing mode for typing by one line is selected in case of 135-type photographic film, and two-line typing mode for typing by two lines is selected in case of IX240-type photographic film.

The color paper 10 for which back printing has been carried out is sent to a processor section 31 via a transporting roller pair 29 and a guide roller 30. The processor section 31 carries out a developing process, a bleach-fix process, a washing process, a drying process and so forth. After that, the processor section 31 cuts away a photo print 32 and discharges it to a tray 33.

A motor 36 is driven to rotate the transporting roller pairs 26 and 29 whenever one printing exposure is over. These transporting roller pairs 26 and 29 transport the color paper 10 frame by frame.

Figure 2:
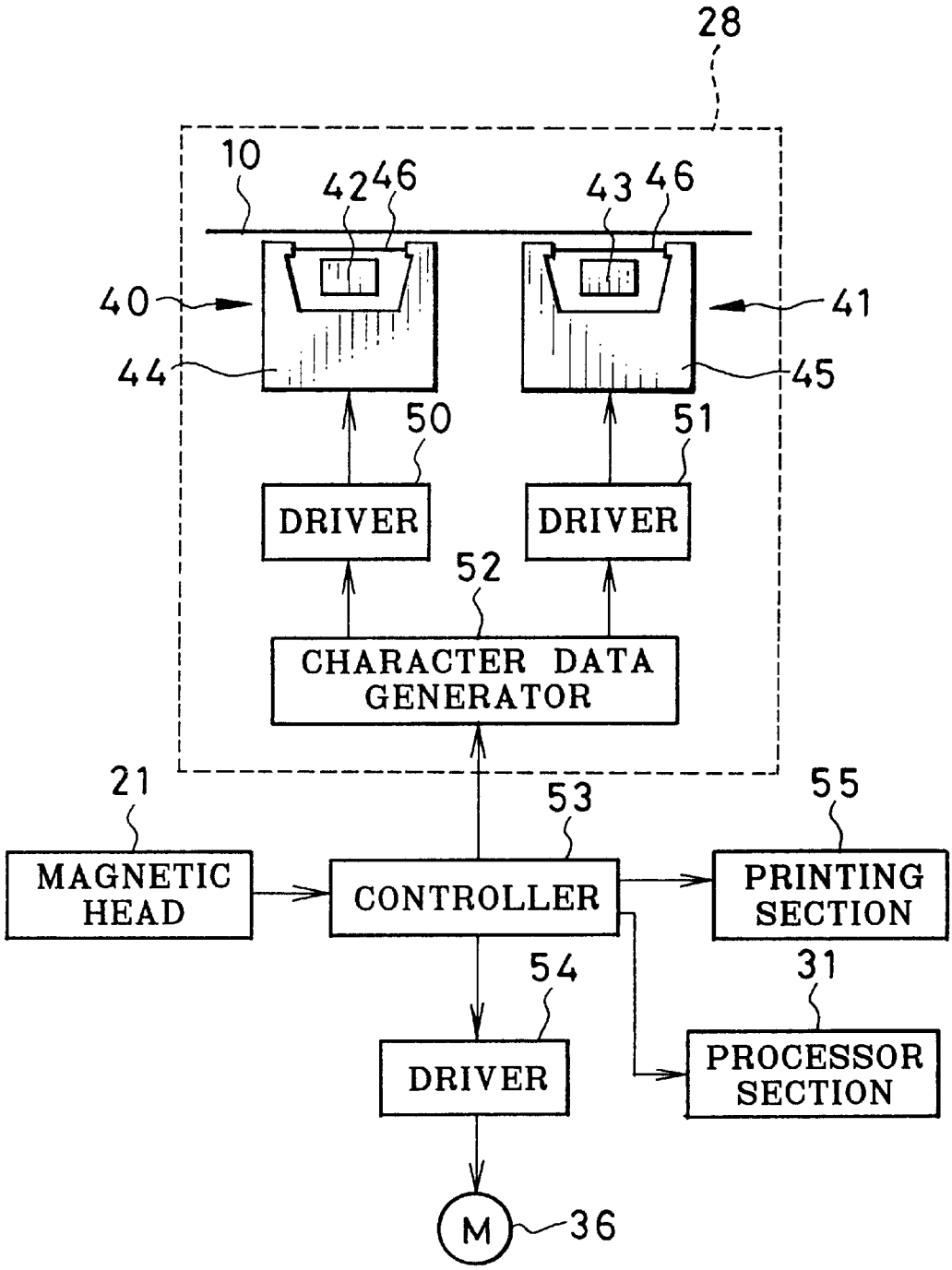
FIG. 2 is a block diagram showing a structure of the back printing section.

In FIG. 2, the back printing section 28 is provided with two typing units 40 and 41. The typing units 40 and 41 are constituted of typing heads 42 and 43 of wire dot type, and ink ribbon cassettes 44 and 45 of endless type. In each of the ink ribbon cassettes 44 and 45, an ink ribbon 46, which is a cloth including ink, is contained in a state that the ink ribbon 46 is wound around a reel.

As to each of the typing heads 42 and 43, a plurality of pins are disposed in matrix as well known. The pin protrudes selectively according to a character being typed and strikes the back of the ink ribbon 46. The ink ribbon 46 is struck in a state that the ink ribbon 46 is superimposed on the color paper 10 so that the ink is transferred to the color paper 10 and the character represented by dot pattern is typed.

Each of the typing units 40 and 41 is fixed and activated to type the characters one by one every time the color paper 10 moves by prescribed pitch. Alternatively, the typing units 40 and 41 may be movable in moving direction of the color paper 10. At this time, the typing units 40 and 41 are moved to type the characters one by one in order while the color paper 10 is stopped. Moreover, a plurality of pins may be disposed in a row to type the character by activating each of the pins at plural times, moving the color paper 10. In case of this typing unit, typing speed is slow, however, the structure is simple because the number of the pins is small.

Drivers 50 and 51 drive the typing heads 42 and 43 respectively in accordance with character data outputted from a character data generator 52. Into the character data generator 52, typing information outputted from a controller 53 is inputted. The typing information includes the film order number, the frame number, the exposure correction value and so forth. The user information read out with the magnetic head 21 is also sent to the character data generator 52 via the controller 53. The back printing section 28 is constituted of the character data generator 52, the drivers 50 and 51, and the typing units 40 and 41.

The controller 53 sends a typing timing signal synchronizing with advancement of the color paper 10, a kind of the typing mode, an instruction for replacing the typing unit, and so forth to the character data generator 52 besides the typing information of the frame number, the exposure correction value and so on. In this embodiment, the typing unit is changed every one order (every one photographic film), however, the typing unit may be changed every plural orders or every printing. In other words, the typing unit may be changed every predetermined number of the photo prints. Alternatively, the typing unit may be changed every prescribed period, for example, each day.

The controller 53 controls a rotation of the motor 36 via a driver 54. Further, the controller 53 controls the processor section 31 and a printing section 55. The printing section 55 is a section for exposing the frame of the photographic film 17 to the color paper 10 and comprises the white light source 13, the three-color filters 14–16, the print lens 19 and the shutter 20 which are shown in FIG. 1.

Figure 3A:
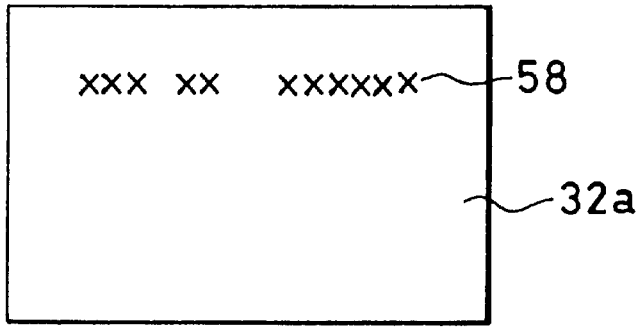
FIGS. 3A, 3B and 3C are explanatory illustrations showing an example of back printing.
Figure 3B:
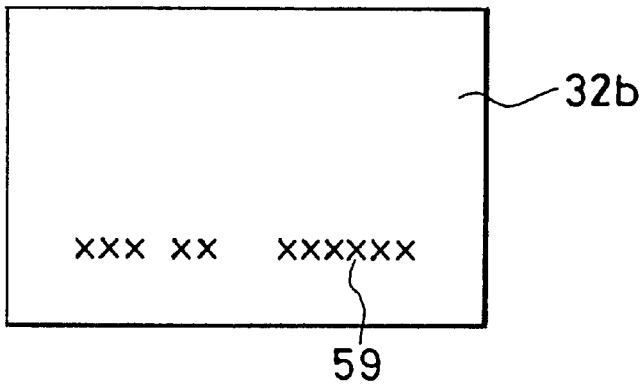
Figure 3C:
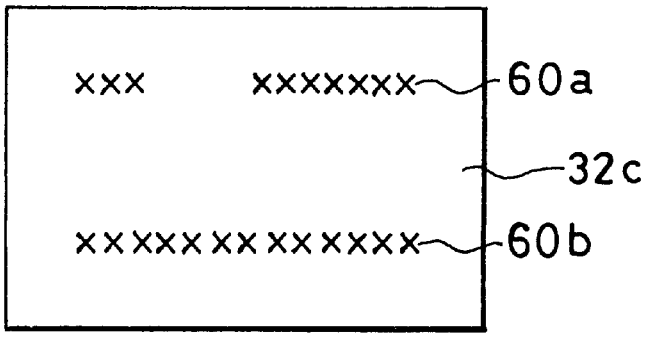

FIGS. 3A to 3C show back printing. In case of one-line typing mode, as shown in FIGS. 3A and 3B, the order number of the photographic film, the frame number of the photographic film, the exposure correction value and so forth are typed for the back face of photo prints 32*a* and 32*b* as one line. Reference numerals 58 and 59 respectively denote one line typed by the typing unit.

In case of two-line typing mode, the message, the photographic date, the photographic condition, the order number of the photographic film, the frame number of the photographic film, the exposure correction value, the ID-number of the laboratory and so forth are typed for the back face of a photo print 32*c* as two lines. Reference numerals 60*a* and 60*b* respectively denote each line typed by the typing units.

Figure 4:
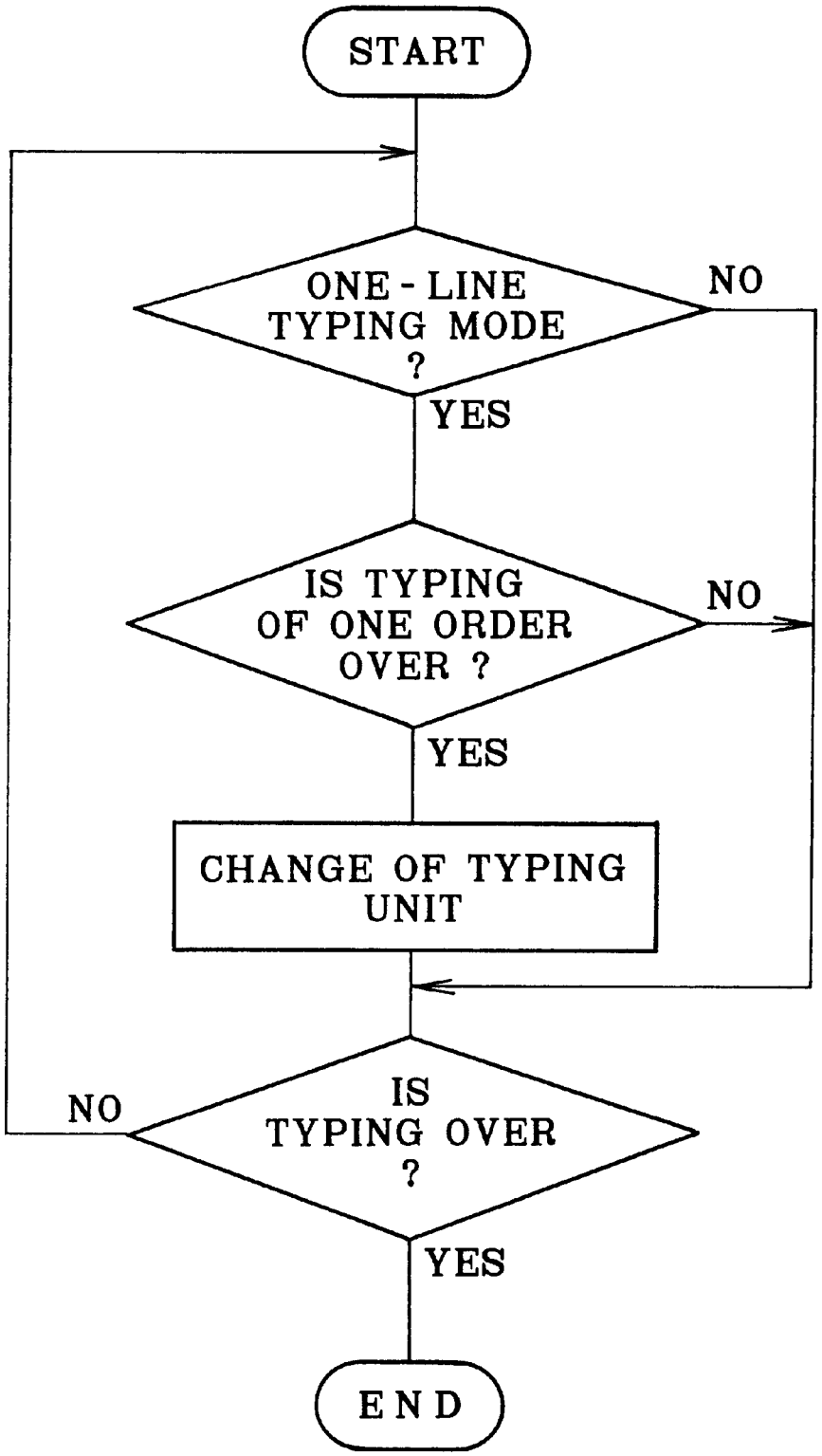
FIG. 4 is a flow chart showing a changeover program of a typing unit in the case of the one-line typing mode.

Next, referring to FIG. 4, an operation of the above structure is described. With respect to the 135-type photographic film and the IX240-type photographic film, widths thereof are different so that a film carrier (not shown) according to the kind of the photographic film for printing is selected. The film carrier is set on a work table (not shown) of the photographic printer.

For example, when the 135-type photographic film is printed, the film carrier for the 135-type photographic film is set on the work table. Upon setting the film carrier, the controller 53 is instructed to print the 135-type photographic film. The controller 53 instructs the character data generator 52 to take the one-line typing mode.

The film carrier sets the frame for printing on the mask plate 22 by advancing the photographic film. As well known, photometry for the frame is carried out by a LATD sensor (not shown) and average densities concerning each color of red, green and blue is measured. From the average densities of three colors, basic exposure is calculated. Further, the frame of the photographic film is scanned by a scanner (not shown). The exposure correction value of each color is calculated from the obtained three-color densities of each point. The exposure correction value is added to the basic exposure and the exposure of each color is calculated.

The controller 53 regulates the printing light in accordance with the exposure of each color by adjusting an amount of the three-color filters 14, 15 and 16 inserted into the optical path. The regulated printing light is diffused with the diffusion box 18 and illuminates the frame for printing. During the illumination, the shutter 20 is opened by predetermined time to print an image of the frame on the color paper 10. After the printing, the controller 53 rotates the motor 36 to advance the color paper 10 by one frame.

The film carrier is operated to advance the photographic film by one frame so that the next frame is set on the mask plate 22. As described above, photometry of the frame, regulation of the light and printing are carried out. These steps are repeated and each frame of the photographic film is printed. After the printing of one photographic film was over, another photographic film is set on the film carrier and the printing is similarly performed.

When the printed color paper 10 reaches the back printing section 28, the controller 53 sends the typing information to the character data generator 52. Further, the controller 53 sends the typing timing signal synchronizing with the rotation of the motor 36 to the character data generator 52.

When the character data generator 52 receives the typing timing signal, the character data generator 52 drives, for example, the typing head 42 via the driver 50 so that the ink of the ink ribbon 46 is transferred to the back face of the color paper 10, Accordingly, one character represented by a dot pattern is recorded. In such a manner, the typing unit 40 types one line character by character in synchronism with advancement of the color paper 10. The typing of one line is carried out corresponding to each picture exposed on the color paper 10.

After the photographic processing is performed for the back printed color paper 10, the color paper 10 is cut into one photo print 32*a* and discharged to the tray 33. As to the photo print 32*a*, the order number of the photographic film, the frame number, the exposure correction value and so forth are typed in one line as shown in FIG. 3A.

When the back printing is carried out for each of exposed pictures relative to one photographic film, the controller 53 instructs the character data generator 52 to change the typing unit. The character data generator 52 rests the typing head 42 and drives the typing head 43 instead of the typing head 42. With the typing head 43, the back printing is carried out line by line for each picture. In case of this typing head 43, the information of one line is typed on an under portion of the back face of the photo print 32*b* as shown in FIG. 3B.

When the IX240-type photographic film is printed, the film carrier for IX240 is set on the work table. In this case, as a developed photographic film is wound up in a cartridge, the cartridge is set on the film carrier. Upon setting the film carrier, the controller 53 instructs the character data generator 52 to take the two-line typing mode.

The film carrier rotates the spool of the cartridge to send out a leader of the photographic film. The film leader is advanced toward the exposure station 12, being nipped by a pair of transporting rollers. During advancement, the common information of the film sensitivity, the photograph number and so forth are read out from the common portion of the track for the user by means of the magnetic head 21. Moreover, by another magnetic head, the ID number of the laboratory, the ID number of the photographic printer and so on are recorded in the common portion of the track for the laboratory.

In IX240 type, the frame is recorded between two perforations. Thus, the frame for printing is set on the exposure station 12 by detecting the perforation with a photo sensor during advancement of the photographic film. On the other hand, just before setting the frame, the user information of the photographic date, the photographic condition, the print number, the print size, the message and so forth are read out from the frame exclusive portion of the track for the user with the magnetic head 21. The user information is sent to the controller 53.

The controller 53 adjusts an advancing amount of the color paper 10 in accordance with the designated print size. Further, the controller 53 adjusts the size of the mask plate 23 and a printing magnification of the print lens 19.

As to the frame set on the exposure station 12, photometry for an area corresponding to the print size is carried out and the exposures of three colors are calculated on the basis of the photometric value. Insert positions of the color filters 14, 15 and 16 are respectively adjusted in accordance with the exposure of each color. Then, the shutter 20 is opened to expose and print the color paper 10. After printing, the controller 53 rotates the motor 36 to advance the color paper 10 by one frame. The film carrier rotates the transporting roller pair to transport the photographic film 17. During this transportation, the exposure correction value and so forth are recorded in the frame exclusive portion of the track for the laboratory with a magnetic head (not shown).

In such a way, each frame recorded in the photographic film is printed on the color paper 10 in order. When the print of one photographic film is over, the transporting roller pair of the film carrier and the spool of the cartridge are rotated in reverse direction so that all of the photographic film is wound back into the cartridge. Next, the cartridge is exchanged to another cartridge and the printing is performed in a similar process.

When the printed color paper 10 reaches the back printing section 28, the controller 53 instructs the character data generator 52 to print the character. After this instruction, the typing timing signal is sent to the character data generator 52 in synchronism with the rotation of the motor 36.

When the character data generator 52 receives the typing timing signal, the character data generator 52 drives the typing heads 42 and 43 via the drivers 50 and 51 respectively to transfer the ink of the ink ribbon 46 to the back face of the color paper 10. Accordingly, one character represented by a dot pattern is recorded. In such a manner, the typing units 40 and 41 print each line character by character in synchronism with the advancement of the color paper 10.

For the back printed color paper 10, the photographic processes are carried out. After that, the color paper 10 is cut into a photo print 32*c* and the photo print 32*c* is discharged to the tray 33. As to the photo print 32*c*, the message, the photographic date, the photographic condition, the order number of the photographic film, the frame number of the photographic film, the exposure correction value, ID number of the laboratory and so forth are typed on the back face thereof in two lines as shown in FIG. 3C.

Each of the typing units 40 and 41 is alternately used in the one-line printing mode so that decreasing states of the ink ribbons become similar to each other. Accordingly, in the two-line typing mode, typing density of one line is not different from the other. Moreover, the two ink ribbon cassettes 40 and 41 are exchanged together when the typing density becomes light.

In the one-line typing mode, the two typing units 40 and 41 are alternately used every photographic film so that print positions are same relative to photo prints corresponding to one photographic film. However, when the user orders the photo prints of two photographic films, the print positions are different relative to each photographic film. In order to keep same print position, the two typing units may be rotated or slid to replace the position thereof.

Figure 5:
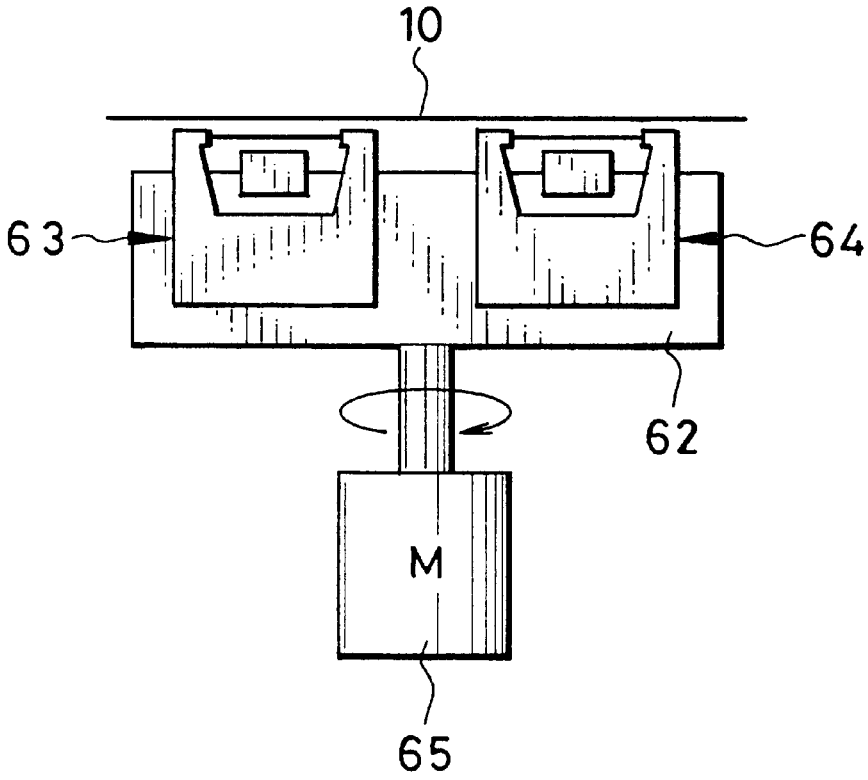
FIG. 5 is an explanatory illustration showing an embodiment in which two typing units are rotated.

In FIG. 5, two typing units 63 and 64 are attached to a holder 62. The holder 62 is a table and the typing units 63 and 64 are disposed at a same distance from a rotational center of the table. When the typing unit is changed, a motor 65 is driven to rotate the holder 62 by 180 degrees so that positions of the two typing units are replaced. At the same time, the typing unit being driven is changed so that the information of one line is typed at the same position of the photo prints.

Figure 6:
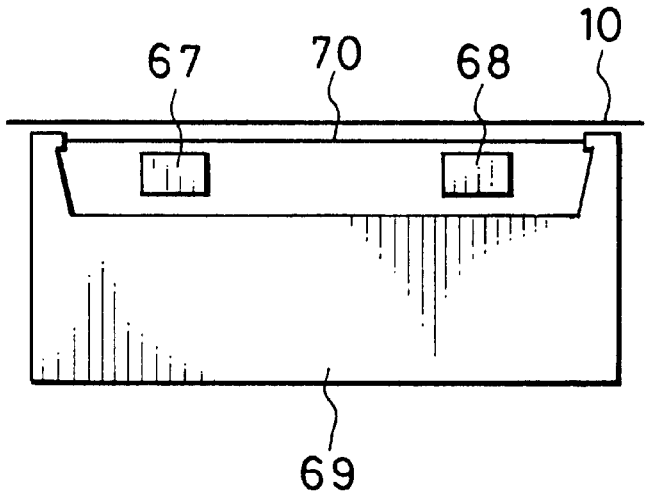
FIG. 6 is an explanatory illustration showing another embodiment in which a large ink ribbon cassette is used.

FIG. 6 shows an embodiment in that a larger ink ribbon cassette 69 is employed such as to surround two typing heads 67 and 68 which are disposed along a perpendicular direction to a moving direction of the color paper 10, namely photo print. An ink ribbon 70 drawn out from the ink ribbon cassette 69 passes by the printing heads 67 and 68 in order and is wound up into the cassette again. In the one-line typing mode, one of the typing heads is always used. And in the two-line typing mode, two typing heads 67 and 68 are used. In this embodiment, only one of the typing heads is used in the one-line typing mode. However, as the ink ribbon is used in common, when the typing mode is exchanged to the two-line typing mode, difference of the printing density does not occur between each of lines.

In the above embodiment, the back printing is carried out on the rear face of the photo print. However, the present invention is available for front printing in which the typing is carried out on an image face of the photo print, for example, on a white rim or a white portion.

Moreover, it is described to change the one-line typing and the two-line typing. However, plural-line typing (for example, three-line typing and four-line typing) and one-line typing may be selectively performed. For example, when one-line typing and three-line typing are performed, three typing units or three typing heads are used. At this time, the three typing units are alternately used in order in the one-line typing mode.

Further, not only two kinds of lines, but typing of more than three kinds of the lines may be selectively carried out. Besides setting the number of typing lines in accordance with the kind of the photographic film, the number of typing lines may be determined in accordance with an amount of information being typed.

Furthermore, in the above-described embodiment, the photographic paper is a continuous photographic paper. However, a sheet cut paper having a prescribed size may be used instead of the continuous photographic paper.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A typing method for a photographic printer having a plurality of typing units which perform typing for a photo print, said typing method comprising the steps of:

driving said typing units in a first typing mode and a second typing mode, any one of said typing units being driven in said first typing mode and said typing units being driven together in said second typing mode; and changing each of said typing units being driven, one of every predetermined number of said photo prints, every predetermined number of orders, and every predetermined period.

2. A typing method for a photographic printer according to claim 1, wherein each of said typing units is an ink ribbon type.

3. A typing method for a photographic printer according to claim 1, wherein each of said typing units performs typing in one line.

4. A typing method for a photographic printer according to claim 1, wherein each of said typing units performs typing on a back face of said photo print.

5. A typing method for a photographic printer according to claim 1, wherein a number of said typing units is two.

6. A typing method for a photographic printer according to claim 1, wherein each of said typing units is disposed between an exposure station which prints an image for a photographic paper and a processor section which carries out developing process for said photographic paper, after exposure typing being performed for said photographic paper during advancement thereof.

7. A typing device for a photographic printer having a plurality of typing units which perform typing for a photo print and are driven in one of a first typing mode and a second typing mode, any one of said typing units being driven in said first typing mode and said typing units being driven together in said second typing mode, said typing device comprising:

holding means for holding said typing units;

moving means for moving said holding means; and controlling means for controlling said moving means and each of said typing units, said controlling means actuating said moving means to set said typing units at a predetermined position and driving said typing units;

wherein each of said typing units being driven is changed one of every predetermined number of said photo prints, every predetermined number of orders, and every predetermined period.

8. A typing device for a photographic printer according to claim 8, wherein each of said typing units is an ink ribbon type.

9. A typing device for a photographic printer according to claim 8, wherein each of said typing units performs typing in one line.

10. A typing device for a photographic printer according to claim 8, wherein each of said typing units performs typing on a back face of said photo print.

11. A typing device for a photographic printer according to claim 8, wherein a number of said typing units is two.

12. A typing device for a photographic printer according to claim 7, wherein said holding means is a table and said moving means is a motor for rotating said table, said typing units being disposed at a same distance from a rotational center of said table.

* * * * *